US008638969B2

(12) United States Patent
Kuhtz et al.

(10) Patent No.: US 8,638,969 B2
(45) Date of Patent: Jan. 28, 2014

(54) EARPHONE, HEADSET AND EAR PAD

(75) Inventors: Jan Peter Kuhtz, Celle (DE); Olav Nisse, Hildesheim (DE); Olaf Leske, Langenhagen (DE); Steffi Beier, Hagenburg (DE)

(73) Assignee: Sennheiser electronic GmbH & Co. KG, Wedemark (DE)

( * ) Notice: Subject to any disclaimer, the term of this patent is extended or adjusted under 35 U.S.C. 154(b) by 454 days.

(21) Appl. No.: 12/643,351

(22) Filed: Dec. 21, 2009

(65) Prior Publication Data

US 2010/0158301 A1 Jun. 24, 2010

(30) Foreign Application Priority Data

Dec. 22, 2008 (DE) ..... 20 2008 016 854 U

(51) Int. Cl.
*H04R 25/00* (2006.01)

(52) U.S. Cl.
USPC ..... 381/374; 381/371; 381/372

(58) Field of Classification Search
USPC ..... 381/309, 71.6, 370, 371, 372, 374, 376; 181/128, 129; 2/209, 423, 909; 128/864, 867
See application file for complete search history.

(56) References Cited

U.S. PATENT DOCUMENTS

| | | | | |
|---|---|---|---|---|
| 4,572,324 | A * | 2/1986 | Fidi et al. | 181/129 |
| 4,674,134 | A * | 6/1987 | Lundin | 2/209 |
| 4,856,118 | A * | 8/1989 | Sapiejewski | 2/209 |
| 2005/0273910 | A1 * | 12/2005 | Cozens et al. | 2/411 |

* cited by examiner

*Primary Examiner* — Huyen D Le
(74) *Attorney, Agent, or Firm* — Kilpatrick Townsend & Stockton LLP

(57) ABSTRACT

An earphone, a headset, and an ear pad for an earphone. The ear pad may having the sealing integrity guaranteed. The headset may have portions with different degrees of softness or firmness.

13 Claims, 3 Drawing Sheets

EARPHONE, HEADSET AND EAR PAD

CROSS-REFERENCE TO RELATED APPLICATIONS

Figure 1A:
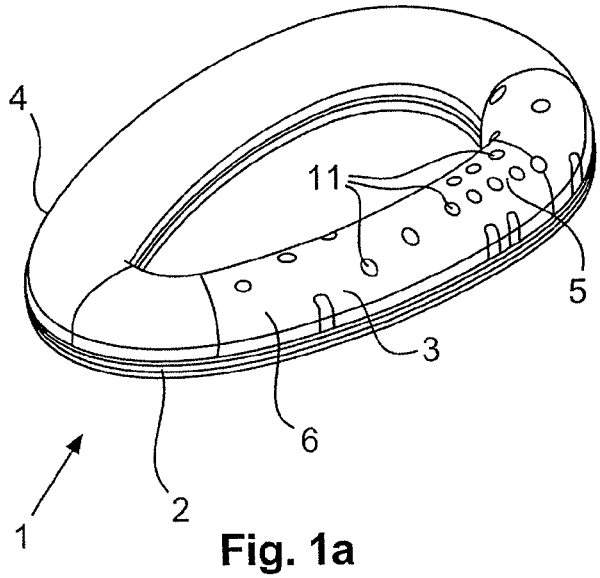

This application claims priority to German Patent Application No. 20 2008 016 854.6, filed Dec. 22, 2008, the disclosure of which is hereby incorporated by reference in its entirety.

The invention concerns an earphone, a headset and an ear pad for an earphone.

Ear pads for headphones or headsets are generally known. Such ear pads serve to make the level of wearing comfort of headphones or the headset as pleasant as possible. Such ear pads are generally fitted to an earphone capsule of the headphones and bear against the head of the user around an ear when the headphones are being worn. In that case the transition between the earphone capsule and the ear should generally be as sound-tight and/or air-tight as possible, which has a positive effect on the acoustic properties when listening. For example interference extraneous noises from the environment are suppressed in that way and the sound pressure of the earphone capsules is transported in the most optimum possible fashion to the auditory canal of an ear.

Previously known ear pads however only adapt to a slight degree to the individual needs of a user for example when simultaneously wearing spectacles and a headphone set.

In addition wearing headphones for a long time or for a prolonged period is found to be uncomfortable by a typical user, that is to say, the longer the typical user wears the headphones, the correspondingly more he feels himself bothered by the headphones.

Thus an object of the present invention is to provide an earphone or a headset having an ear pad with improved sealing in respect of the volume enclosed by the ear pad on the ear. In particular the invention seeks to provide that sealing integrity is guaranteed in relation to spectacle wearers. A further or alternative object is to improve long-term wearing comfort when wearing headphones or a headset.

According to the invention the object is attained by an earphone as set forth in claim 1 and a headset as set forth in claim 11.

Thus there is provided an earphone or a headset having an ear pad with a core layer having at least a first portion and at least a second portion. In that case the at least one first portion is softer than the at least one second portion.

The (annular) core layer of the ear pad is divided into various portions which each have different respective degrees of softness or firmness. For example a first portion is softer than a second portion. If, when wearing headphones provided with such an ear pad, the first portion lies in the region of a spectacles side arm of a pair of spectacles which is also being worn, adaptation of the ear pad to that situation (earphone+spectacles) is improved by better deformability or increased softness of the ear pad in that portion. That means that a better seal is achieved between the ear and the ear pad if the wearer of the corresponding headphones is also wearing spectacles. A sealing action which is optimised in that way also increases the acoustic quality of headphones which use the corresponding ear pad. Long-term wearing comfort is also improved.

In accordance with a further aspect of the invention the ear pad has a carrier device for carrying the ear pad and for fixing the ear pad to the headphones. Such a carrier device provides for easily fitting the ear pad to the headphones or simple interchangeability of ear pads. The carrier device includes for example a plastic plate on which the annular core layer which is made for example from a foam can be fixed.

In accordance with a further aspect of the invention the ear pad has a cover which at least partially encloses the annular core layer. That provides protection for the core layer and thus the service life thereof can be correspondingly increased. The cover can be for example interchangeable. The cover can comprise in particular a material which feels particularly pleasant on the skin. The cover which at least partially encloses the annular core layer can be fixed for example to the carrier device or the plastic plate. Such a cover can comprise for example artificial leather, plastic, textile fabric and/or leather.

In accordance with a further aspect of the invention optionally the at least one first annular portion and the at least one second annular portion are arranged symmetrically relative to a longitudinal axis of the ear pad, which extends through a lower edge or end and an upper edge or end of the ear pad. The symmetrical arrangement of the corresponding portions permits in particular right-left rotatability of the headphones or headset using an ear pad according to the invention. This means that, irrespective of the way in which the headphones or headset are worn, that is to say right or left wearing mode for the headphones, an approximately equal seal is afforded for the ear by the ear pad.

In accordance with a further aspect of the invention in the case of an ear pad having a lower edge or end and an upper edge or end the at least one first annular portion is arranged above the center between the lower edge and the upper edge. In that case the second annular portion adjoins from above the at least one first annular portion. Such an arrangement of the first and second annular portions improves in particular the sealing effect in relation to the ear when wearing corresponding headphones and a pair of spectacles for the softer annular portion is in the region of the spectacles side arm and can thus be easily adapted to the situation with the spectacles side arm.

In accordance with a further aspect of the invention the annular core layer of the ear pad has at least one third annular portion which is harder than the second annular portion. It has been found that an improved seal between the earphone capsule and the ear is achieved in particular under the ear with a harder implementation for the annular core layer in the annular portion which lies beneath the ear when the ear pad is being worn. Accordingly a suitable division of the annular portions is the provision of a first annular portion in the region of the spectacles side arms and a third annular portion in the region beneath the ear. The other annular portions present a degree of softness or a firmness which is harder than the firmness of the first annular portion but softer than that of the third annular portion. The at least one third annular portion, like the at least one first annular portion and the at least one second annular portion, can be arranged symmetrically relative to a longitudinal axis of the ear pad, which extends through a lower edge and an upper edge of the ear pad. That affords right/left rotatability of the headphones with a corresponding ear pad while retaining the acoustic properties.

In accordance with a further aspect of the invention, in the case of an ear pad according to the invention having a lower edge or end the at least one third annular portion is arranged in the region of the lower edge of the ear pad. In that case the at least one third annular portion adjoins a second annular portion. The sealing effect in relation to an ear can be improved in particular in the lower region, with such an ear pad.

In accordance with a further aspect of the invention the at least one first annular portion of the annular core layer has a higher density of openings such as for example holes or slots than the at least one second annular portion. In that way the firmness or softness of the individual annular portions is modified with the introduction of openings such as for example holes. Mini openings in an annular portion accordingly provide a softer annular portion than fewer openings in another annular portion. As an alternative to the introduction of openings, it is also possible for slots to be introduced into the annular core layer. In that respect, slots which are disposed more closely together produce a lower level of firmness or produce a softer material than slots which are further away from each other.

In accordance with a further aspect of the invention the annular core layer is made up of at least a first layer and a second layer. The ratio in respect of thickness of the first and second layers is different in the first annular portion, in relation to the ratio of thickness in the second annular portion. In that case the first layer is softer than the second layer. Accordingly the different firmness of the annular portions is achieved by different layers involving a different level of softness and a different thickness, that is to say the extent of the layer transversely relative to the ring. It is also possible to use more than two layers.

In accordance with a further aspect of the invention the annular core layer is made up with a foam-like material. Such a material allows easy manufacture and also permits slots and holes to be easily introduced or also permits various foam-like layers to be easily brought together.

The embodiments by way of example and advantages of the present invention are described in greater detail hereinafter with reference to the accompanying drawings.

Figure 1B:
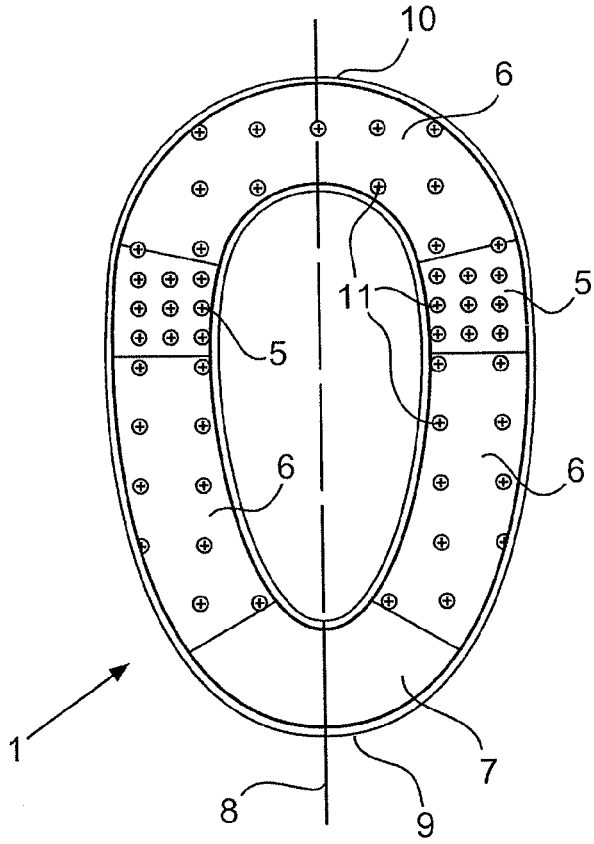
Figure 2A:
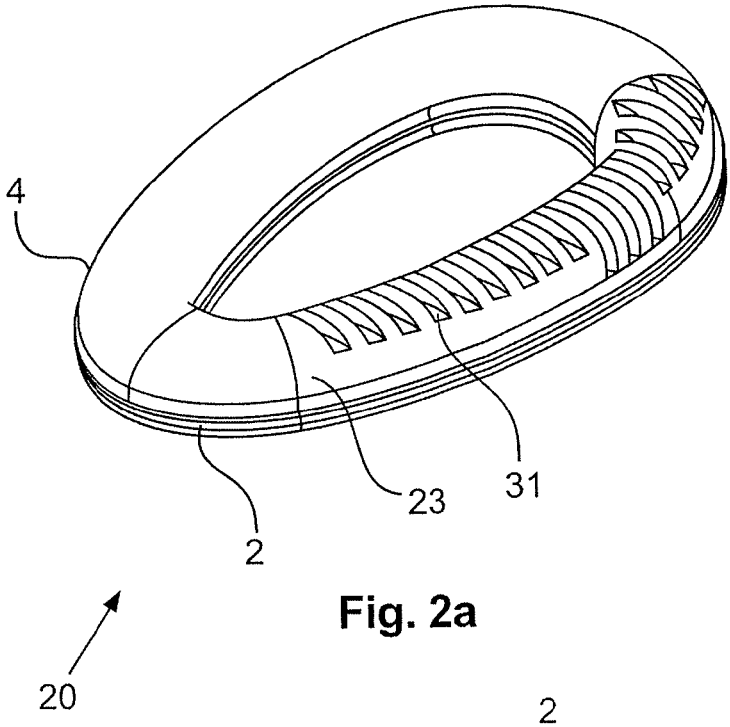
Figure 2B:
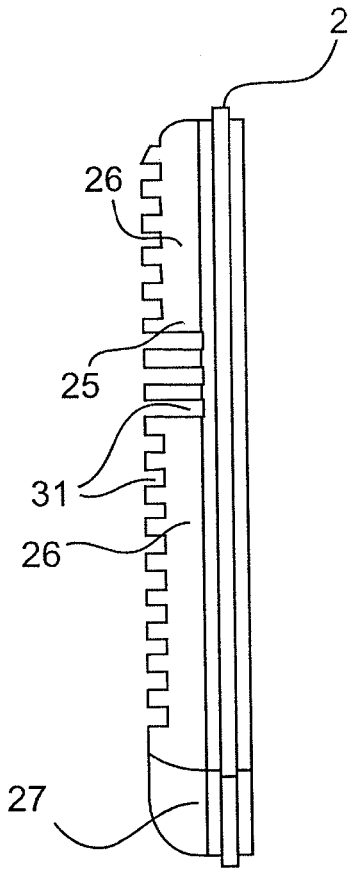
Figure 3A:
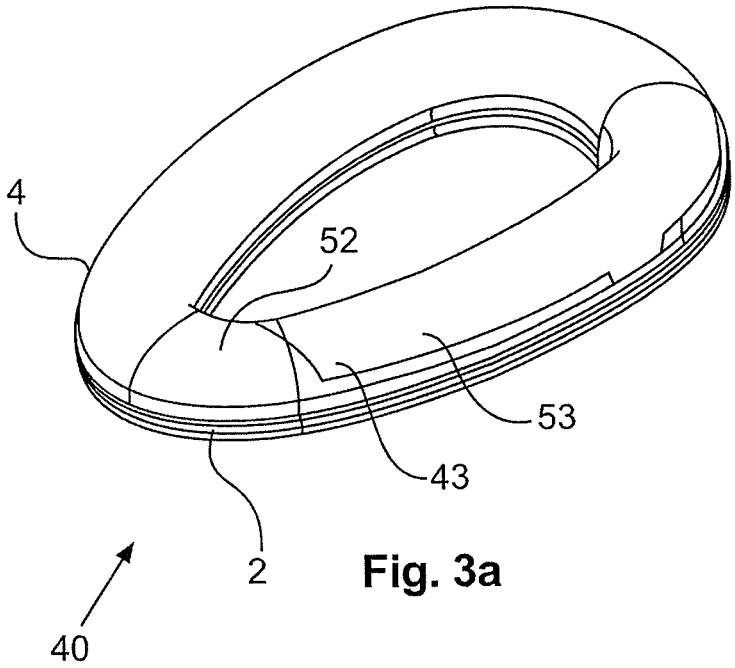
Figure 3B:
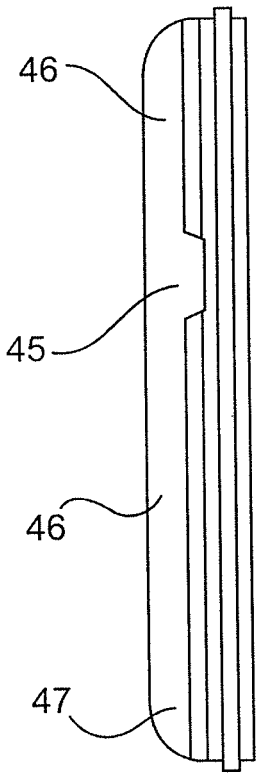

FIG. 1*a* shows a perspective view of an ear pad according to a first embodiment, FIG. 1*b* shows a plan view of an ear pad according to the first embodiment, FIG. 2*a* shows a perspective view of an ear pad according to a second embodiment, FIG. 2*b* shows a side view of an ear pad according to the second embodiment, FIG. 3*a* shows a perspective view of an ear pad according to a third embodiment, and FIG. 3*b* shows a side view of an ear pad according to the third embodiment.

FIG. 1*a* shows a perspective view of an ear pad 1 according to a first embodiment. The ear pad 1 has a plastic plate 2, a for example annular core layer 3 and a cover 4. The plastic plate 2 serves for carrying the annular core layer 3 and for fixing the ear pad 1 to a pair of headphones or to a headset. The annular core layer 3 has first and second portions 5, 6 and comprises for example a foam-like material or a foam. The cover 4 can comprise in particular artificial leather or plastic. In FIG. 1*a* the cover 4 only partially covers the visible part of the (annular) core layer 3 so that the structure of the (annular) core layer 3 can be seen. Holes 11 are provided in the (annular) core layer 3. That modifies the firmness of the (annular) core material which preferably comprises a foam. If the density (or size and number) of holes 11 is selected to be greater in a first (annular) portion 5 than in a second (annular) portion 6, then the first (annular) portion 5 is softer than the second (annular) portion 6.

FIG. 1*b* shows a plan view of the ear pad according to the first embodiment. In this case the cover 4 is not shown so that the structure of the annular core layer 3 can be seen. The (annular) core layer 3 of the ear pad 1 has two first annular portions 5, three second annular portions 6 and a third annular portion 7. The density of the holes 11 introduced into the (annular) core layer 3 is greater in the first annular portions 5 than in the second annular portions 6 and is there in turn greater than in the third annular portion 7. That provides that the first annular portions 5 are of lower firmness than the second annular portions 6 and they in turn are of lesser firmness than the third annular portion 7. The first annular portions 5 are therefore softer than the second annular portions 6. The second annular portions 6 are softer than the third annular portion 7.

The illustrated arrangement of the first annular portions 5, the second annular portions 6 and the third annular portion 7 provides in particular that the sealing action and the wearing comfort of headphones or a headset using the ear pad 1 are improved. Particularly when wearing a pair of spectacles and when simultaneously wearing a pair of headphones with the ear pad 1, the spectacles side arm is in or at the first annular portion 5 which represents a for example very soft annular portion. In that way the annular core layer 3, in the region of the first annular portion 5, can adapt well to the situation afforded by the spectacles side arm, and achieves a good sealing action in relation to the ear of the user, in spite of a spectacles side arm being worn. In the second annular portions 6, the annular core layer has a medium degree of softness.

It has also been found that the sealing action in respect of the ear pad which bears against an ear is improved if a portion of the annular core layer with a higher level of firmness is used beneath the ear. Accordingly the third annular portion 7 which is in the lower region or in a region in the proximity of the lower edge 9 has fewer holes (or none at all) than the first annular portions 5 and the second annular portions 6. Thus the third annular portion 7 is firmer than the first annular portions 5 and the second annular portions 6. That region is disposed beneath the ear when the ear pad 1 is being worn.

The plan view of the ear pad 1 in FIG. 1*b* also shows a longitudinal axis 8 which extends through a lower edge 9 and an upper edge 10 of the ear pad 1. The first, second and third annular portions 5, 6 and 7 can be arranged symmetrically relative to the longitudinal axis 8. That therefore provides that, upon right-left transposition of a pair of headphones or a headset on which the ear pad 1 is mounted, the improved wearing comfort and the improved sealing action are maintained, particularly in relation to spectacles wearers. The concept of a softer annular portion for spectacles side arms and a harder annular portion beneath the ear can be incorporated individually or in combination into the annular core layer.

FIG. 2*a* shows a perspective view of an ear pad 20 in accordance with a second embodiment. The ear pad has a plastic plate 2, an annular core layer 23 and a cover 4. The ear pad 20 substantially corresponds to the ear pad 1 with the difference that the different levels of firmness or the different degrees of softness of different annular portions are not achieved by the introduction of holes into the annular core layer, but by the introduction of openings or slots which involve differing density and/or a different depth in various annular portions.

FIG. 2*b* shows a side view of the ear pad 20 without cover 4. A first annular portion 25, two second annular portions 26 and a third annular portion 27 can be seen in the side view. The arrangement of the annular portions is also symmetrical as in FIG. 1*b*. The illustrated spacing of the slots 31 is admittedly the same but the depth of the slots 31 in the first annular portion 25 is deeper than in the second annular portions 26. The third annular portion 27 does not have any slots 31. The first annular portion 25 is softer than the second annular portion 26 as the slots formed are deeper than the slots in the second annular portions 26. A lesser degree of firmness of the first annular portion 25 in relation to the second annular portion 26 can also be achieved by an increased density of the slots 31. Equally the concepts of increased density of the slots and/or the depth of the slots for establishing the firmness of an annular portion can be used in combination or in themselves.

FIG. 3*a* shows a perspective view of an ear pad 40 in accordance with a third embodiment. The ear pad 40 has a plastic plate 2, an annular core layer 43 and a cover 4. The ear pad 40 substantially corresponds to the ear pads in accordance with the first and second embodiments (FIGS. 1*a*, 1*b*, 2*a* and 2*b*) with the difference that the differing firmness in various annular portions is achieved by the annular core layer 43 being formed with different layers which involve a different level of firmness and involve different proportions in respect of the total thickness of the annular core layer. In FIG. 3*a* the annular core layer 43 includes a first layer 52 and a second layer 53. Preferably the first layer 52 and the second layer 53 involve foam layers. In that case the second layer 53 is softer than the first layer 52. The proportion of the first layer 52 in relation to the total thickness/total gauge of the annular core layer 43 is different in different annular portions.

FIG. 3*b* shows a side view of the ear pad 40. The first annular portions 43, the second annular portions 46 and the third annular portion 47 are arranged as shown in FIG. 1*b*. The first annular portion 45 is softer than the second annular portions 46 and the third annular portion 47 by being formed exclusively from the second layer 53. The second annular portions 46 are formed in combination from the first layer 52 and the second layer 53. The third annular portion 7 exclusively consists of the first layer 52. Thus different levels of firmness or degrees of softness are achieved for the different annular portions. This third embodiment involves in particular the concept of providing different degrees of softness in different annular portions by the use of a plurality of layers of differing softness or differing firmness, which have a different proportion in relation to the total thickness of the annular core layer 43. In addition the interface between two adjacent annular portions of the annular core layer can be inclined relative to the interface between two adjacent annular portions so as to provide a fluid transition in respect of firmness between the annular portions. The second layer 53 is preferably a foam layer which has a high proportion in terms of a soft component. The first layer 52 is preferably a foam layer which has a high proportion in respect of a hard component.

The cover which at least partially encloses the annular core layer can be fixed for example to the carrier device or the plastic plate. Such a cover can comprise for example artificial leather, plastic, textile fabric and/or leather.

The above-described ear pad can be used in relation to a pair of headphones, an earphone, a headset or ear protectors.

The number, density and configuration of the openings, holes or slots can be varied to alter the stiffness of the ear pads.

The invention claimed is:

1. An earphone comprising:

at least one ear pad having a core layer which has at least a first annular portion and at least a second annular portion, wherein the at least one first annular portion is softer than the at least one second annular portion, wherein the ear pad has a lower and an upper end, wherein the at least one first annular portion and the at least one second annular portion are arranged symmetrically relative to a longitudinal axis of the ear pad that extends through the lower end and the upper end of the ear pad, wherein the at least one first annular portion has a first plurality of openings, comprising holes or slots, and the at least one second annular portion has a second plurality of openings comprising holes or slots, wherein the first plurality of openings has a greater number of openings than the second plurality of openings, and wherein the material of the first annular portion is the same as the material of the second annular portion.

2. An earphone as set forth in claim 1 comprising a carrier device for fixing the ear pad to the headphones.

3. An earphone as set forth in claim 1 comprising a cover which at least partially encloses the core layer.

4. An earphone as set forth in claim 1 comprising a lower end and an upper end, wherein the at least one second annular portion is provided in the region of the upper end.

5. An earphone as set forth in claim 1 wherein the core layer has at least a third annular portion which is harder than the at least one second annular portion.

6. An earphone as set forth in claim 5 comprising a lower end, wherein the at least one third annular portion is arranged in the region of the lower end of the ear pad, and the at least one third annular portion adjoins a second annular portion.

7. An earphone as set forth in claim 1, wherein the core layer comprises an annular core layer, which is made up from at least a first layer and a second layer whose ratio in respect of thickness is different in the at least one first annular portion in relation to the ratio in respect of thickness in the at least one second annular portion, wherein the first layer is softer than the second layer.

8. An earphone as set forth in claim 1 wherein the core layer is made up of a foam material.

9. A headset comprising:

at least one ear pad having a single-layer core which has at least a first portion and at least a second portion, wherein the at least one first portion is softer than the at least one second portion, wherein the first and second portions represent a first and a second annular portion of the single-layer core, wherein the first portion has a first plurality of openings, comprising holes or slots, and the second portion has a second plurality of openings comprising holes or slots, wherein the first plurality of openings has a greater number of openings than the second plurality of openings, and wherein the material of the first portion is the same as the material of the second portion.

10. An ear pad for an earphone, a headset or ear protectors comprising:

a single-layer annular core which has at least a first portion and at least a second portion, wherein the at least one first portion is softer than the at least one second portion, wherein the first and second portions represent a first and a second annular portion of the single-layer annular core, wherein the first portion has a first plurality of openings, comprising holes or slots, and the second portion has a second plurality of openings comprising holes or slots, wherein the first plurality of openings has a greater number of openings than the second plurality of openings, and wherein the material of the first portion is the same as the material of the second portion.

11. Headphones comprising an ear pad as set forth in claim 10.

12. Ear protectors comprising an ear pad as set forth in claim 10.

13. An earphone comprising:

at least one ear pad having an annular core having a single layer and forming a loop, the annular core including:

a first annular portion; and a second annular portion, the first annular portion having a better deformability than the second annular portion, wherein the at least one first annular portion and the at least one second annular portion are configured to be colinear along the single layer loop of the annular core, wherein the first annular portion has a first plurality of openings, comprising holes or slots, and the second annular portion has a second plurality of openings comprising holes or slots, wherein the first plurality of openings has a greater number of openings than the second plurality of openings, and wherein the material of the first annular portion is the same as the material of the second annular portion.

* * * * *

UNITED STATES PATENT AND TRADEMARK OFFICE

CERTIFICATE OF CORRECTION

PATENT NO. : 8,638,969 B2
APPLICATION NO. : 12/643351
DATED : January 28, 2014
INVENTOR(S) : Kuhtz et al.

It is certified that error appears in the above-identified patent and that said Letters Patent is hereby corrected as shown below:

In the Abstract:

Title Page, second column, Abstract, Item 57, line 1: please delete "An earphone, a headset, and an ear pad for an earphone. The ear pad may having the sealing integrity guaranteed" and insert --An earphone, a headset, and an ear pad for an earphone, the ear pad having sealing integrity"--.

In the Claims:

Column 6, Line 22, Claim 7: please delete "made up from" and insert --made up of--.

Column 6, Line 26, Claim 7: after "portion," please insert --and--.

Column 6, Line 53, Claim 10: please delete the "," after "wherein the first portion has a first plurality of openings."

Signed and Sealed this
Third Day of June, 2014

Michelle K. Lee

Michelle K. Lee
*Deputy Director of the United States Patent and Trademark Office*